United States Patent [19]

Vestergaard

[11] Patent Number: 4,492,569

[45] Date of Patent: Jan. 8, 1985

[54] OVEN

[75] Inventor: Alex D. Vestergaard, Kastrup, Denmark

[73] Assignee: Ingeniørfirmaet Lytzen KS, Herlev, Denmark

[21] Appl. No.: 470,182

[22] Filed: Feb. 28, 1983

[30] Foreign Application Priority Data

Mar. 3, 1982 [DK] Denmark ..... 915/82

[51] Int. Cl.[3] ..... B01D 45/00; B01D 39/00; A21B 1/00

[52] U.S. Cl. ..... 432/72; 55/481; 55/493; 126/21 A

[58] Field of Search ..... 432/72; 55/481, 490, 55/493, DIG. 9; 126/21 A

[56] References Cited

U.S. PATENT DOCUMENTS 2,715,359 8/1955 Mackintosh et al. ..... 126/21 A
2,996,189 8/1961 Salterbach ..... 55/481
3,780,721 12/1973 Durth ..... 126/21 A
3,788,046 1/1974 Kaeppler et al. ..... 55/490

*Primary Examiner*—John J. Camby
*Attorney, Agent, or Firm*—Fitch, Even, Tabin & Flannery

[57] ABSTRACT

An airtight oven comprises at least two doors and a filter arrangement, through which the air within the oven is circulated in a closed circuit by means of a circulator. This closed circuit optionally includes means for adjusting the temperature of the air. The filter arrangement comprises a frame loosely secured to a resilient, airtight, trumpet-like suspension arrangement which in turn is secured to the rim of a channel permitting passage of the circulating air, whereby the major portion of this rim is formed by the oven shell. In this manner it is possible for the frame of the filter during operation to operate and expand in proportion to the oven shell without the channel thereby leaking.

2 Claims, 3 Drawing Figures

OVEN

The invention relates to an airtight oven separating two chambers which contain their respective media or their respective qualities of the same medium, and of which at least one medium must not be mixed with the other medium, said oven comprising at least two doors and a filter arrangement, through which the air within the oven is circulated in a closed circuit by means of a circulator, said closed circuit optionally including means for adjusting the temperature of the circulating air.

The filters must be placed in such a manner that the air cannot bypass them during its circulation. Furthermore, the filters must be replaceable, and the filter frame should be capable of operating and expanding in proportion to the oven shell.

These objects are according to the invention obtained by the filter arrangement comprising a frame loosely secured to a resilient, funnel-shaped, tubular, airtight suspension arrangement which in turn is secured to the rim of a channel carrying the circulating air, whereby the major portion of said rim may be formed by the oven shell.

The funnel-shaped suspension arrangement may advantageously be secured to the parts of the oven shell during the assembling thereof, preferably through welding.

In order to facilitate the replacement of the filters, the supporting frame with the filters may rest on one or more rails by means of wheels and be moveable along said rails upon release from the funnel-shaped suspension arrangement. In this manner the supporting frame is easily moved to the opposite side of the oven, whereby the filters are adjacent the door. Subsequently, it is easy to pull out the filters from the supporting frame, to remove them from the oven, and to insert new filters.

The invention will be described below with reference to the accompanying drawing, in which.

Figure 1:
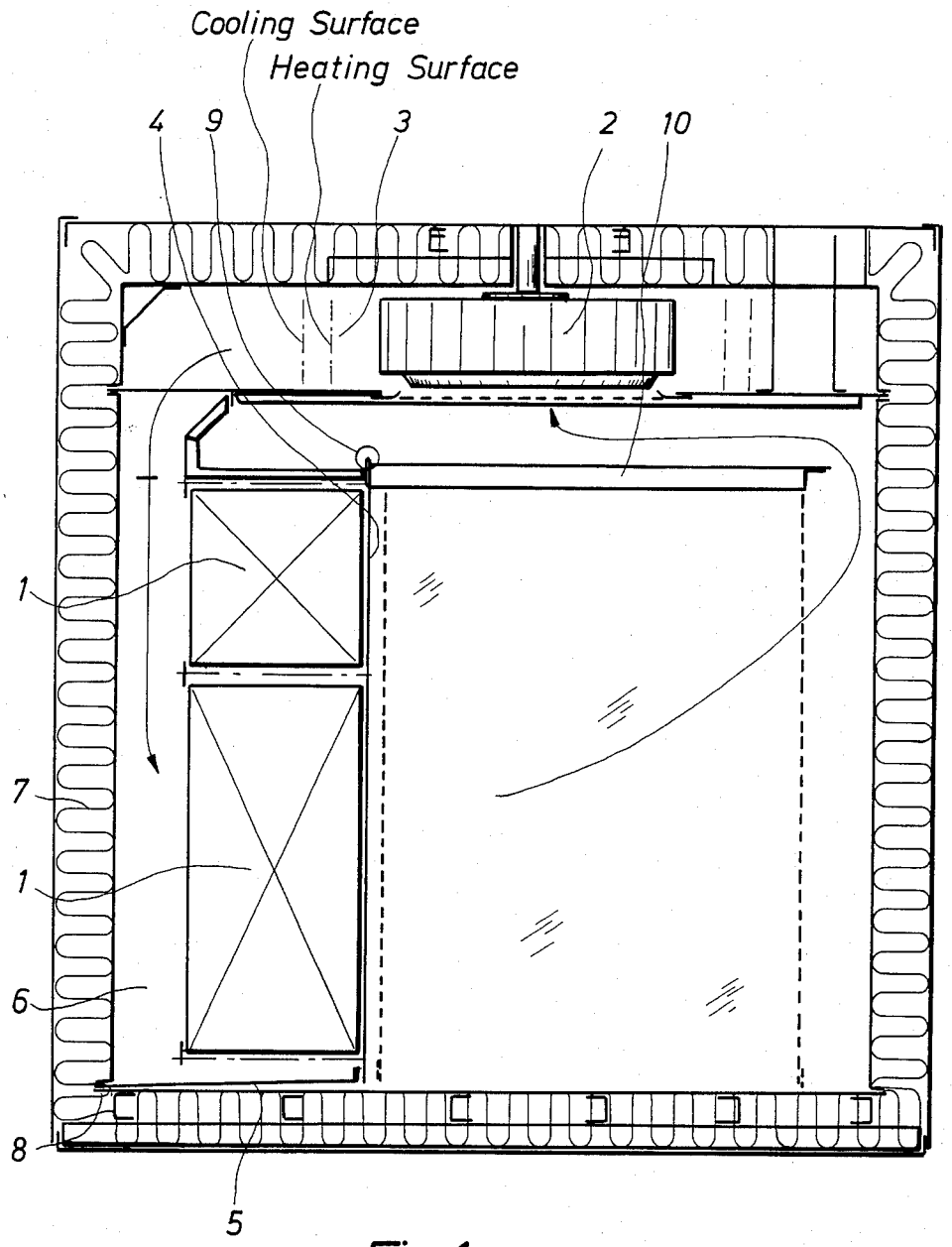
FIG. 1 is a sectional view of an oven according to the invention.
Figure 2:
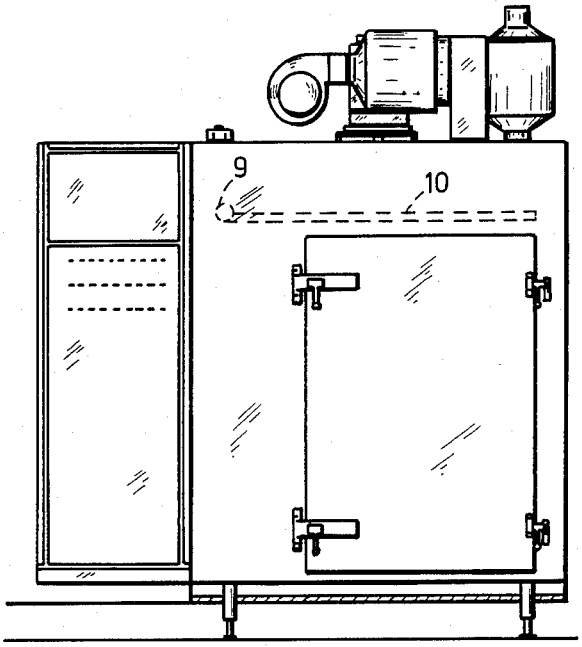
FIG. 2 illustrates on a smaller scale the oven, seen from the outside.
Figure 3:
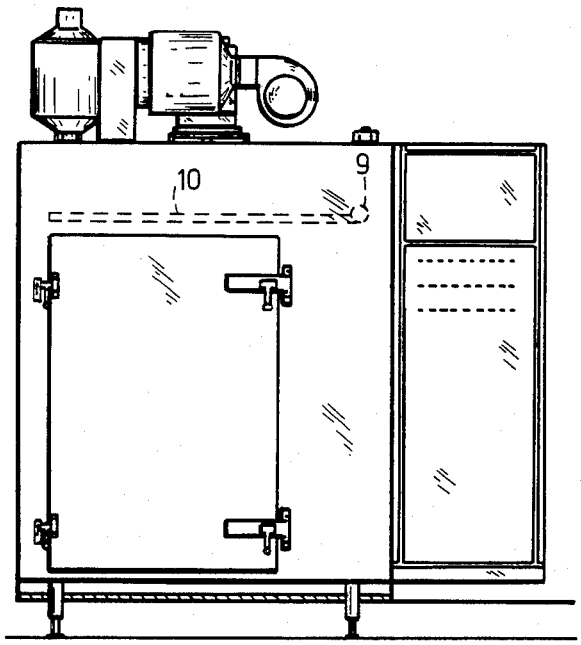
FIG. 3 shows the second door of the furnace.

The oven illustrated in the drawing is airtight. The oven is situated in a partition between a sterile chamber and an impure chamber and comprises two airtight doors. The two doors cannot be opened simultaneously. In one side of the oven a filter through which the air is to be passed is mounted, said air being circulated by a circulator 2 in a closed circuit consisting of channels. Means 3 for adjusting the temperature of the air are provided in the closed circuit. The filter 1 is mounted in a supporting frame 4. The technical problem is that it should be possible for the supporting frame to operate and expand in response to the changes of the temperature and the channels should be tight. According to the invention the frame 4 is loosely secured to a resilient, funnel-shaped, airtight suspension arrangement 5 which in turn is secured to the rim of a channel 6 carrying the circulating air. In this manner it is possible for the frame 4 to operate and expand irrespective of the remaining part of the oven without the circulating channel 6 thereby leaking. When parts of the circulating channel 6 are formed by the oven shell 7, the funnel-shaped suspension arrangement 5 may advantageously be secured to said parts of the oven shell 7 during the assembling thereof, as indicated at 8, preferably through welding. In this manner a very reliable and completely airtight construction is obtained.

According to the invention the supporting frame 4 with the filters 1 rest on one or more rails 10 by means of wheels. After release from the funnel-shaped suspension arrangement 5, the supporting frame 4 with the filters 1 are moveable along the rails. The rails 10 extend through the entire oven and are situated above the doors of the oven in such a manner that a replacement of the filters may take place through the doors. Therefore, the oven need only be idle for a very short time in connection with a replacement of the filters 1.

The filters are made of wavy fibre glass folded zigzag in a steel frame and packed and sealed by a mass of silicon. Such filters become more and more efficient. Upon use for a long period, the drop in pressure across the filters becomes too great and the filters must be replaced.

FIG. 1 furthermore shows how the possibly polluted air is sucked out of the chamber and circulates through a channel ending in a filter so that the air fed to the chamber comes directly from the filter.

A slight overpressure may optionally exist in the oven.

The oven should be acceptable to class 100 corresponding to less than 100 particles per cubic foot.

The ovens makes it possible to transfer articles from one chamber to the other without gaseous impurity particles being transferred simultaneously from one chamber to the other, said chambers being separated by the oven.

I claim:

1. An oven for connectively separating two otherwise independent, isolated medium chambers, said oven comprising:

means forming an air-tight oven shell;

an internal four sided chamber within said oven shell;

means in said oven adjacent said chamber forming a closed path channel for conducting air within said oven;

means for circulating air in said closed path;

at least two doors in said oven shell, one located adjacent each of two of the sides of said chamber, only one of said doors being able to be opened at a time;

a filter assembly located in said oven at one side of said chamber and in said closed path through which all air circulating therein must pass;

means forming a funnel-shaped suspension system releasably mounting said filter assembly in said closed path, said suspension system being secured to the outermost portion of said means forming said air channel;

a frame included in said filter assembly mounting the filters of the filter assembly through which all air passes in said closed path, said frame being releasably mounted by said suspension system to allow expansion and contraction of said frame with temperature changes while said funnel-shaped suspension system correspondingly expands and contracts, thereby preventing bypass of air around the filters; and a rail and wheel combination supporting said frame and located over the doors to allow said frame when released by said suspension system to roll adjacent at least one of the doors and allow access to the filters.

2. An oven as claimed in claim 1 wherein the funnel-shaped suspension system is secured during the assembling of said oven by welding.

* * * * *